US007775682B2

(12) United States Patent
Zhou

(10) Patent No.: US 7,775,682 B2
(45) Date of Patent: Aug. 17, 2010

(54) SEVEN COLORS LIGHT EMITTING MODULE AND SEVEN COLORS DECORATING LAMP STRING INCLUDING THE SAME

(76) Inventor: Weiping Zhou, 1-1-1401, Yongan Building, Guangdong Road, Hexi District, Tianjin (CN) 300203

( * ) Notice: Subject to any disclaimer, the term of this patent is extended or adjusted under 35 U.S.C. 154(b) by 0 days.

(21) Appl. No.: 12/200,371

(22) Filed: Aug. 28, 2008

(65) Prior Publication Data

US 2008/0316742 A1 Dec. 25, 2008

Related U.S. Application Data

(63) Continuation of application No. PCT/CN2006/003641, filed on Dec. 28, 2006.

(30) Foreign Application Priority Data

Feb. 28, 2006 (CN) ..... 2006 1 0013230

(51) Int. Cl.
*F21V 9/00* (2006.01)

(52) U.S. Cl. ..... 362/249.06; 362/231; 315/294

(58) Field of Classification Search ..... 362/800, 362/249.06, 231
See application file for complete search history.

(56) References Cited

U.S. PATENT DOCUMENTS 7,331,689 B2 * 2/2008 Chen ..... 362/240
7,490,957 B2 * 2/2009 Leong et al. ..... 315/51
7,492,063 B2 * 2/2009 Bayat et al. ..... 307/115

* cited by examiner

*Primary Examiner*—Anabel M Ton
(74) *Attorney, Agent, or Firm*—Matthias Scholl P.C.; Matthias Scholl

(57) ABSTRACT

A seven-color light emitting module and a seven-color decorating lamp string comprising the same. The seven-color light emitting module includes a lampshade made of a transparent plastic or synthetic resin, and a lamp socket on which three colors self-flashing light emitting diode, a zener diode, a current limiting resistance and a double-side printed circuit board (PCB) are sealed. The three colors light emitting diodes connect with PCB and connect with the zener diode in parallel. One end of the zener diode or two ends of the zener diode connects with the current limiting resistance in series. A transparent epoxy resin or silicon glue is filled in the lampshade. The seven-color decorating lamp string include a power supply plugs, a power supply module which has a PCB and a rectifying and filter circuit connected by wires and a plurality of said seven colors light emitting modules.

10 Claims, 8 Drawing Sheets

SEVEN COLORS LIGHT EMITTING MODULE AND SEVEN COLORS DECORATING LAMP STRING INCLUDING THE SAME

CROSS-REFERENCE TO RELATED APPLICATIONS

This application is a continuation of International Patent Application No. PCT/CN2006/003641 with an international filing date of Dec. 28, 2006, designating the United States, now pending, and further claims priority benefits to Chinese Patent Application No. 200610013230.7 filed Feb. 28, 2006. The contents of all of the aforementioned applications, including any intervening amendments thereto, are incorporated herein by reference.

BACKGROUND OF THE INVENTION

1. Field of the Invention

The invention relates to a decorating lamp, and particularly to a seven-color light-emitting module and a seven-color decorating lamp string comprising the same.

2. Description of the Related Art

With fast development of economy and improvement in living standard and cultural quality, decorating lamps are of great importance for decoration of high buildings, entertainment places, roads, shops, and especially sceneries in festivals and grand gathering places in cities. However, a conventional decorating lamp string comprises a monochromatic lamp and a bicolor lamp, decorating and illumination effects of which are not ideal, some of which have complex structure, high processing cost and power consumption, some of which have poor waterproof, impact resistance and electrical performance, and thus use effect and lifetime thereof are affected.

At present, some oversea products employ three-color self-flashing LEDs to overcome drawbacks in decoration and illumination caused by the monochromatic lamp and the bicolor lamp. However, since interelectrode voltage of the three-color self-flashing LED cannot be effectively regulated in a range of rated voltage, it always operates in an abnormal state, which not only affects use effect and lifetime, but also makes it impossible to serially connect tens of three-color self-flashing LEDs to city power. Therefore, present circuit design usually employs a transformer to step down or decreases the number of three-color self-flashing LEDs to prevent the interelectrode voltage from exceeding the rated voltage. However, this makes the circuit complex in structure, causes a limited application range since few lamps can be connected for a lamp string, and affects aesthetic appearance and use of the decorating lamp string since a step down transformer is employed. In addition, since the lampshade is not firm enough and improper designed, it is prone to be broken due to impact and squeezing; since the lampshade uses transparent materials, light-mixing and light-emitting effect are poor, and aesthetic appearance is affected. Besides, as one three-color self-flashing LED is opened and does not operate, the rest of the three-color self-flashing LEDs serially connected thereto will not emit light, and the lamp string cannot operate normally.

SUMMARY OF THE INVENTION

In view of the above-described problems, it is one objective of the invention to provide a seven-color light-emitting module and a seven-color decorating lamp string comprising the same that feature good color-mixing effect and transparency, high anti-break strength, significant waterproof effect, low power consumption, safe and reliable performance, convenient use, long life, simple manufacture and wide applications.

A seven-color light-emitting module of the invention comprises a lampshade and a lamp socket; wherein the lampshade is made of ivory-white light-transmission plastics or synthetic resin with good color-mixing effect and transparency, a three-color self-flashing LED, a Zener diode, a current-limiting resistor and a printed circuit board (PCB) sealed in the lampshade are disposed on the lamp socket, the three-color self-flashing LED is connected with the PCB, and both ends of the three-color self-flashing LED are parallel connected to the Zener diode, one or both ends of the Zener diode are serially connected to the current-limiting resistor, and the lampshade is filled with materials like transparent epoxy resin or silicon glue.

The PCB is a double-side PCB, and the Zener diode and the current-limiting resistor disposed thereon are piece components.

One or two three-color self-flashing LEDs are disposed in the lampshade.

A transparent sealing layer for sealing the three-color self-flashing LED, the PCB and the piece components on the PCB are disposed in the lampshade.

A thickness of the lampshade is 2-12 mm, and usually 5-10 mm.

A positioning hole is axially disposed on a side wall at the bottom of the lampshade.

The lampshade may be sphere, column, rectangle, rhombus, lantern, or any other shapes of heads of various cartoon animals.

The lampshade and the lamp socket can be integrally formed into sphere, column, rectangle, rhombus, lantern, or any other shapes of heads of various cartoon animals.

A seven-color decorating lamp string of the invention comprises a plug, and a power supply and a plurality of seven-color light-emitting modules connected via wires; wherein the power supply comprises a house filled with materials like epoxy resin or silicon glue and a rectifying and filter circuit connected to a printed circuit board (PCB); the seven-color light-emitting module comprises a lampshade, a lamp socket, and a three-color self-flashing LED, a Zener diode, a current-limiting resistor and the PCB disposed on the lamp socket and sealed in the lampshade.

The three-color self-flashing LED is connected with the PCB, and both ends of the three-color self-flashing LED are parallel connected to the Zener diode; one or both ends of the Zener diode are serially connected to the current-limiting resistor; and the lampshade is filled with materials like transparent epoxy resin or silicon glue.

The rectifying and filter circuit is a half-wave rectifying circuit, a structure of which is: one end of the power input is serially connected to a rectifying diode and an anti-surge resistor, a discharging resistor and a filtering capacitor are parallel connected between the other end of the anti-surge resistor and the other end of the power supply, and a circuit comprising a plurality of serial-connected seven-color light-emitting modules is parallel connected between both ends of the filtering capacitor.

The rectifying and filter circuit is a full-wave rectifying circuit, a structure of which is: one end of the power input is serially connected to a dividing capacitor and then to an alternating input end of a silicon rectifying bridge, a cathode of the silicon rectifying bridge is serially connected to an anti-surge resistor, a discharging resistor and a filtering capacitor are parallel connected between the other end of the anti-surge resistor and an anode of the silicon rectifying bridge, and a circuit comprising a plurality of serial-connected seven-color light-emitting modules is parallel connected between both ends of the filtering capacitor.

A plurality of said seven-color decorating lamp strings can be connected altogether in structure to form a lamp string.

Advantages of the Invention Comprise:

1. Since the lampshade is made of ivory-white light-transmission plastics or synthetic resin with good color-mixing effect and transparency, light emitted from the seven-color decorating lamp string composed of the light-emitting module is soft and colorful, meanwhile, the seven-color decorating lamp string has high intensity, heat tolerance as well as long lifetime, and is not easily damaged or deformed.
2. Space in the enclosing cover of the power supply and the lampshade of the seven-color light-emitting module is filled with materials like epoxy resin or silicon glue, components and solder joints therein can be tightly fixed and sealed very well. Thus the invention features high tolerance to water pressure and significant waterproof performance, and applications thereof are enhanced.
3. By using the Zener diode, (1) an interelectrode voltage of the three-color self-flashing LED is regulated in a range of rated voltage, so that it operates in a more reasonable state, and thus a lifetime of the lamp string is prolonged;

(2) If the three-color self-flashing LED emits light with different colors or does not work, redundant current will be bypassed;

(3) If a three-color self-flashing LED in the lamp string is opened and does not emit light, the lamp string will still operate properly;

(4) A large and expensive step-down transformer that is used in a normal lamp string is omitted, which simplifies overall design of the lamp string. Meanwhile, the number of seven-color light-emitting modules forming the seven-color decorating lamp string is expanded to several hundreds or even thousands.

4. To some extent, the dividing capacitor and the silicon rectifying bridge allows for free setting of the number of seven-color light-emitting modules in each seven-color decorating lamp string, which makes applications of the invention even wider.
5. Since the double-side PCB and the piece components are employed in the lampshade of the seven-color light-emitting module, a size of the seven-color light-emitting module is reduced, a structure and a process thereof are more simple, product quality is improved, processing cost is decreased, large-scaled production is implemented, and the product is novel, simple and beautiful.

Since a three-color self-flashing LED that is capable of emitting light with seven colors is used in the seven-color light-emitting module, If two three-color self-flashing LEDs are selected in the seven-color light-emitting module, two groups of combinations both with seven different colors can be formed, and therefore more colors can be generated, which makes the decorating lamp more colorful and a dreaming effect more remarkable.

DETAILED DESCRIPTION OF THE EMBODIMENTS

Figure 1:
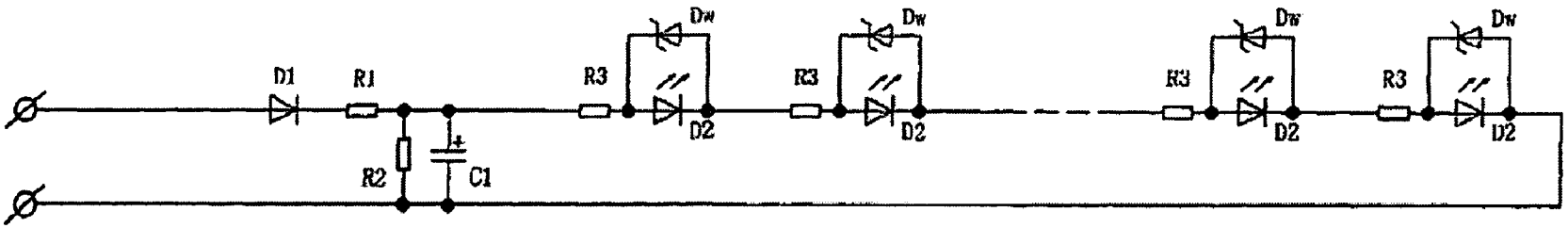
FIG. 1 is a circuit diagram of the invention.

Detailed description of a seven-color light-emitting module and a seven-color decorating lamp string comprising the same will be given below with reference to accompanying drawings and embodiments.

As shown in FIGS. 1-8, the seven-color decorating lamp string of the invention comprises a plug 1, a power supply 2 and a plurality of seven-color light-emitting modules 3 connected via a wire 4. Each of the seven-color light-emitting modules 3 comprises a lampshade 31, a lamp socket 32, a three-color self-flashing LED D2, a Zener diode Dw, a current-limiting resistor R3 and a printed circuit board (PCB), the PCB being connected to the three-color self-flashing LED D2, both ends of the three-color self-flashing LED D2 being parallel connected to the Zener diode Dw, one or both ends of the Zener diode Dw being serially connected to the current-limiting resistor R3, and the seven-color light-emitting modules 3 being connected together via the wire 4.

In this embodiment, the power supply 2 may employ different structure.

For example, the power supply 2 comprises an enclosing cover (not shown), a PCB (not shown), a rectifying diode D1, a surge-proof resistor R1, a discharging resistor R2 and a filtering capacitor C1. As shown in FIG. 1, one end of a power input is serially connected to the rectifying diode D1 and the surge-proof resistor R1, so as to perform half-wave rectification; The charging resistor R2 and the filtering capacitor C1 are parallel connected between the other end of the surge-proof resistor R1 and the other end of the power input, so as to generate a pulsatile DC voltage; and a circuit comprising a plurality of serial-connected seven-color light-emitting modules 3 is parallel connected between both ends of the filtering capacitor C1.

Figure 2:
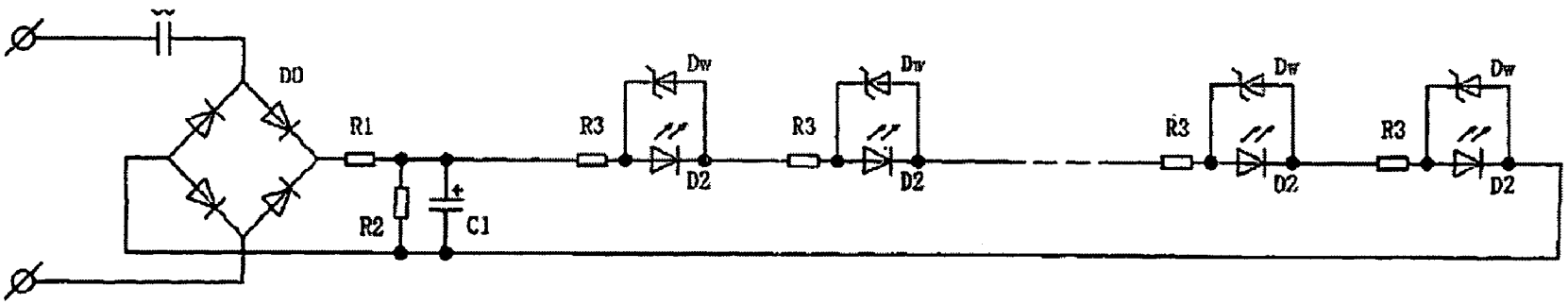
FIG. 2 is a circuit diagram of the invention as a dividing capacitor is used.

In another example, the power supply 2 comprises an enclosing cover, and a dividing capacitor C0, a silicon rectifying bridge D0, a surge-proof resistor R1, a discharging resistor R2 and a filtering capacitor C1 disposed in the enclosing cover. As shown in FIG. 2, the power input is serially connected to the dividing capacitor C0 and then to an alternating input end of the silicon rectifying bridge D0 so as to perform full-wave rectification; a cathode of the silicon rectifying bridge D0 is serially connected to the anti-surge resistor R1; the discharging resistor R2 and the filtering capacitor C1 are parallel connected between the other end of the anti-surge resistor R1 and an anode of the silicon rectifying bridge D0, so as to generate a pulsatile DC voltage; and a circuit comprising a plurality of serial-connected seven-color light-emitting modules 3 is parallel connected between both ends of the filtering capacitor C1.

For the seven-color light-emitting module 3 in the seven-color decorating lamp string, since the Zener diode Dw is parallel connected between a cathode and an anode of the three-color self-flashing LED D2, compared with products in the art, electric properties of the invention are improved as follows:

1. An interelectrode voltage of the three-color self-flashing LED D2 is regulated in a range of rated voltage, and prevented from operating in an abnormal voltage state that may reduce lifetime of the three-color self-flashing LED D2, and thus a lifetime of the seven-color decorating lamp string is prolonged.
2. As the three-color self-flashing LED D2 emits homogeneous light, polychromatic light and three-color light, redundant current in the circuit is bypassed (Characteristics of the three-color self-flashing LED: operating current when emitting homogeneous light, polychromatic light and three-color light is different, the least current is consumed as red homogeneous light is emitted), so that the three-color self-flashing LED D2 always operates in a normal state, and lifetime thereof is prolonged.
3. If a three-color self-flashing LED D2 is opened and does not emit light, current of the seven-color decorating lamp string is bypassed, and voltage distribution of the other three-color self-flashing LEDs D2 are not affected and emit light as usual, so that the entitle circuit operates normally and reliability of the invention is improved.

The Zener diode Dw allows the seven-color decorating lamp string to be directly connected to city power, and therefore a step-down transformer that is used in the prior art is omitted, which simplifies structure of the invention, reduces cost, offers easy use, improves aesthetic appearance and enhances applications.

The dividing capacitor C0 in the power supply 2 is capable of selecting capacitors with different capacitance and withstanding voltage, according to power input voltage and the number of serial-connected three-color self-flashing LEDs; as a ratio between an overall voltage of the serial-connected three-color self-flashing LEDs and the power input voltage is appropriate, the dividing capacitor C0 and the silicon rectifying bridge D0 are no longer needed.

The lampshade 31 employs ivory-white light-transmission plastics or synthetic resin (for example, polypropylene, polyethylene, polycarbonate and so on) with good color-mixing effect and transparency. A thickness of the lampshade 31 can be set in a range of 2-12 mm according to a diameter thereof and the number of three-color self-flashing LEDs D2 disposed therein, and preferably 5-10 mm as better transparency and color-mixing effect are required. The lampshade 31 is capable of uniformly mixing polychromatic light and three-color light emitted by the three-color self-flashing LED D2, so as to generate a single and uniform effect of composite light.

In order to improve insulation, waterproof and impact performance of the seven-color decorating lamp string, space in the enclosing cover of the power supply and the lampshade 31 is filled with transparent materials 34 like epoxy resin or silicon glue.

An objective of filling the enclosing cover of the power supply 2 with materials 34 like epoxy resin or silicon glue is to coat printed circuit boards of voltage-dividing, rectifying, filtering and discharging components and all solder joints, so as to realize insulation from the air and special waterproof effect.

Moreover, by way of filling the lampshade 31 with materials 34 like epoxy resin or silicon glue and installing the lamp socket 32, it is possible to coat the three-color self-flashing LED D2, printed circuit boards having voltage regulating and current limiting components, as well as all solder joints, so as to effectively improve waterproof and impact performance.

To highlight waterproof effect of the light-emitting module and to insulate all components disposed therein and all the solder joints from the air, a transparent coating layer (not shown) capable of sealing one or two three-color self-flashing LEDs D2 and printed circuit boards of welding components thereon.

Figure 8:
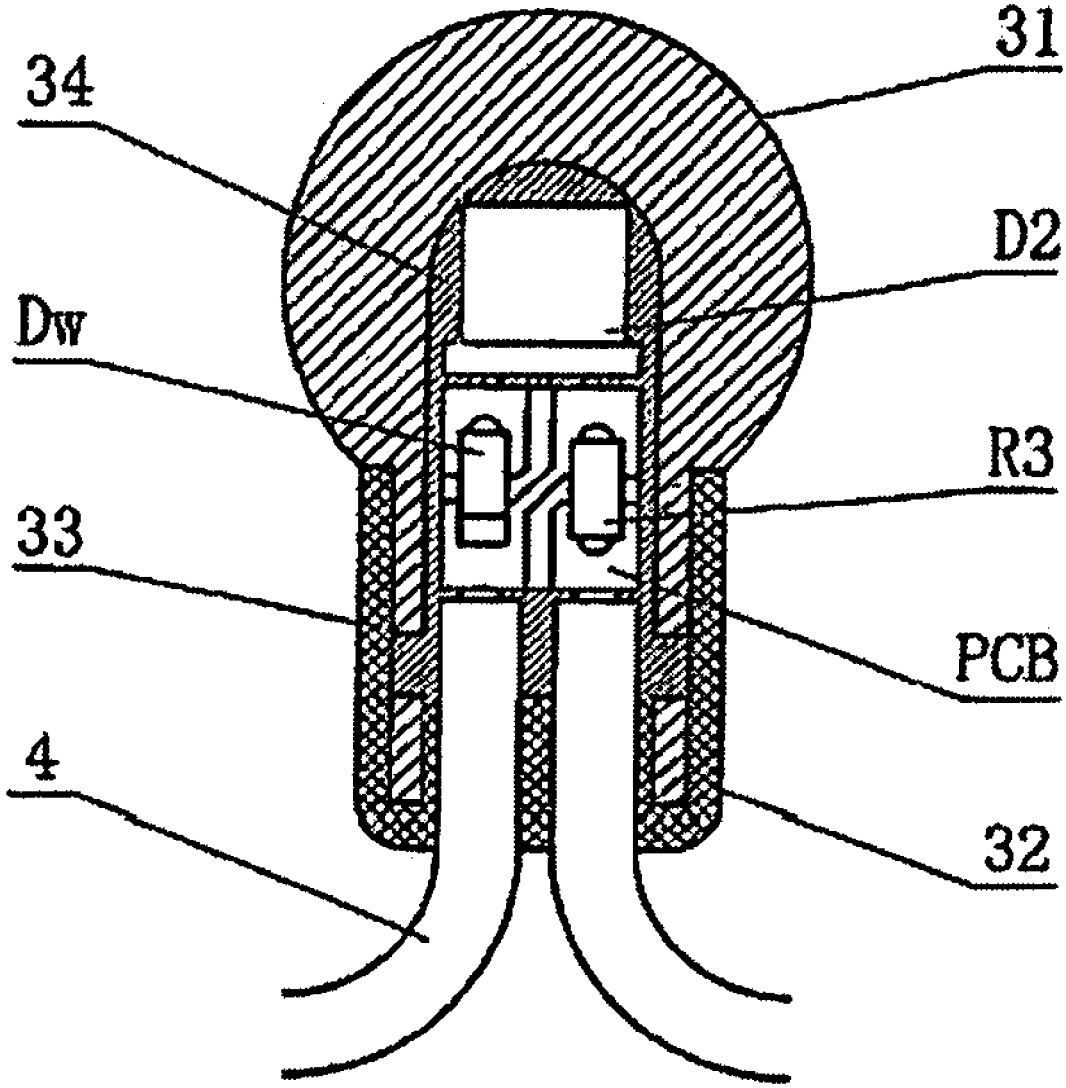
FIG. 8 is a sectional view of a seven-color light-emitting module in FIG. 3.

A pair of positioning holes 33 are axially disposed on a side wall at the bottom of the lampshade 31 (as shown in FIG. 8), as materials like epoxy resin or silicon glue are introduced, redundant remainders overflow from the lampshade 31, enter the positioning holes 33 and are solidified, and a material 34 with two protruding columns is formed. Thus, adhesion and sealing are realized, PCBs and electronic components in the lampshade 31 are fixed, and the lampshade 31 is prevented from detaching from the lamp socket 32.

Figure 3:
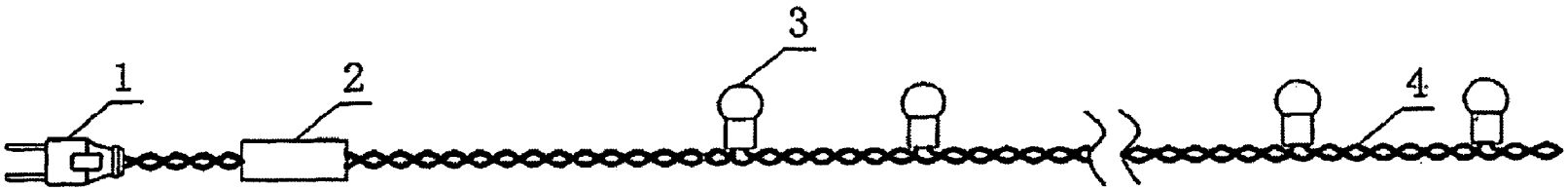
FIG. 3 illustrates a scenario where a lamp socket is columnar and a lampshade is sphere.
Figure 4:
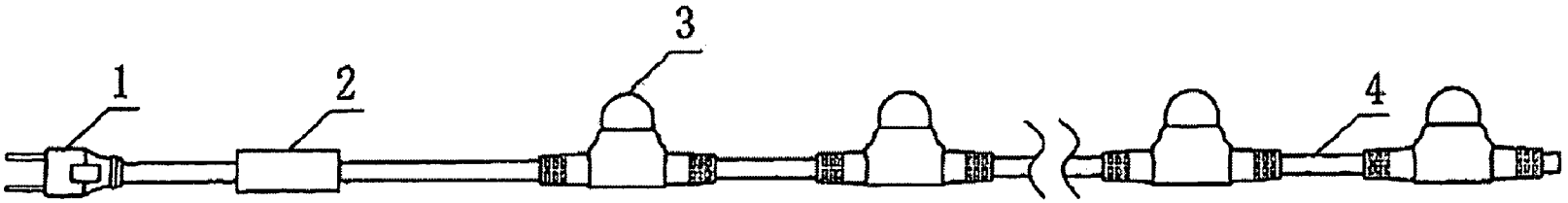
FIG. 4 illustrates a scenario where a lamp socket is disciform and a lampshade is columnar and has a circle top.
Figure 5:
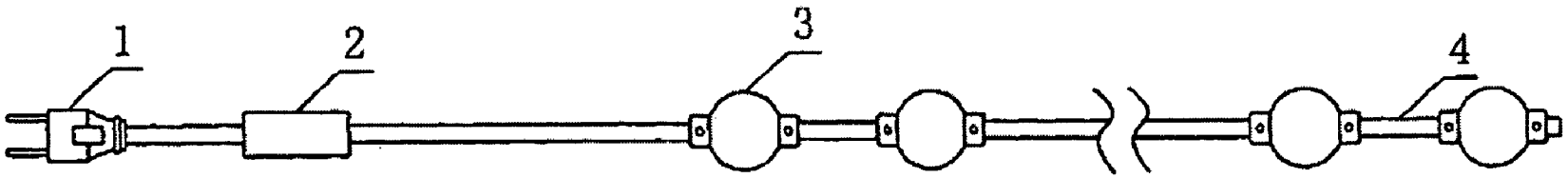
FIG. 5 illustrates a scenario where a lamp socket and a lampshade are molded into a sphere shape.
Figure 6:
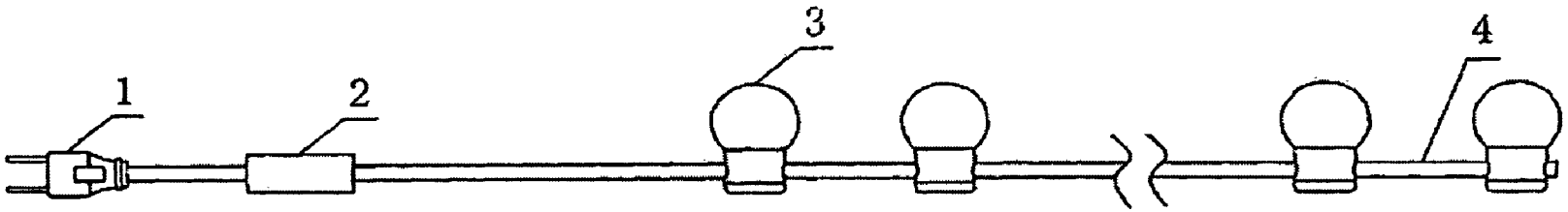
FIG. 6 illustrates a scenario where a wire passes through a side portion of a columnar lamp socket.

The lampshade 31 is molded into a sphere, column, rectangle, rhombus, lantern, or any other shapes of heads of various cartoon animals. For example, a closed sphere-shaped lampshade 31 can construct a sphere-shaped seven-color decorating lamp string, the lamp socket 32 connected to the lampshade 31 may be molded into a columnar shape (as shown in FIGS. 3 and 6), a disc shape (as show in FIG. 4) and so on; the lampshade 31 connected to the lampshade 32 may be molded into a columnar shape with a circle top (as show in FIG. 4); the lampshade 31 and the lamp socket 32 may be integrally molded into a sphere, column, rectangle, rhombus, lantern, or any other shapes of heads of various cartoon animals, for example a sphere shape (as shown in FIG. 5). The disc-shaped lamp socket 32 is adhered to the surface of objects like buildings, which improves stability, decorative quality and consistency. The sphere-shaped seven-color decorating lamp string is applicable to places like fountains and pools as an underwater ornament, as well as both sides of roads, shops, buildings and various entertainment places.

Figure 7:
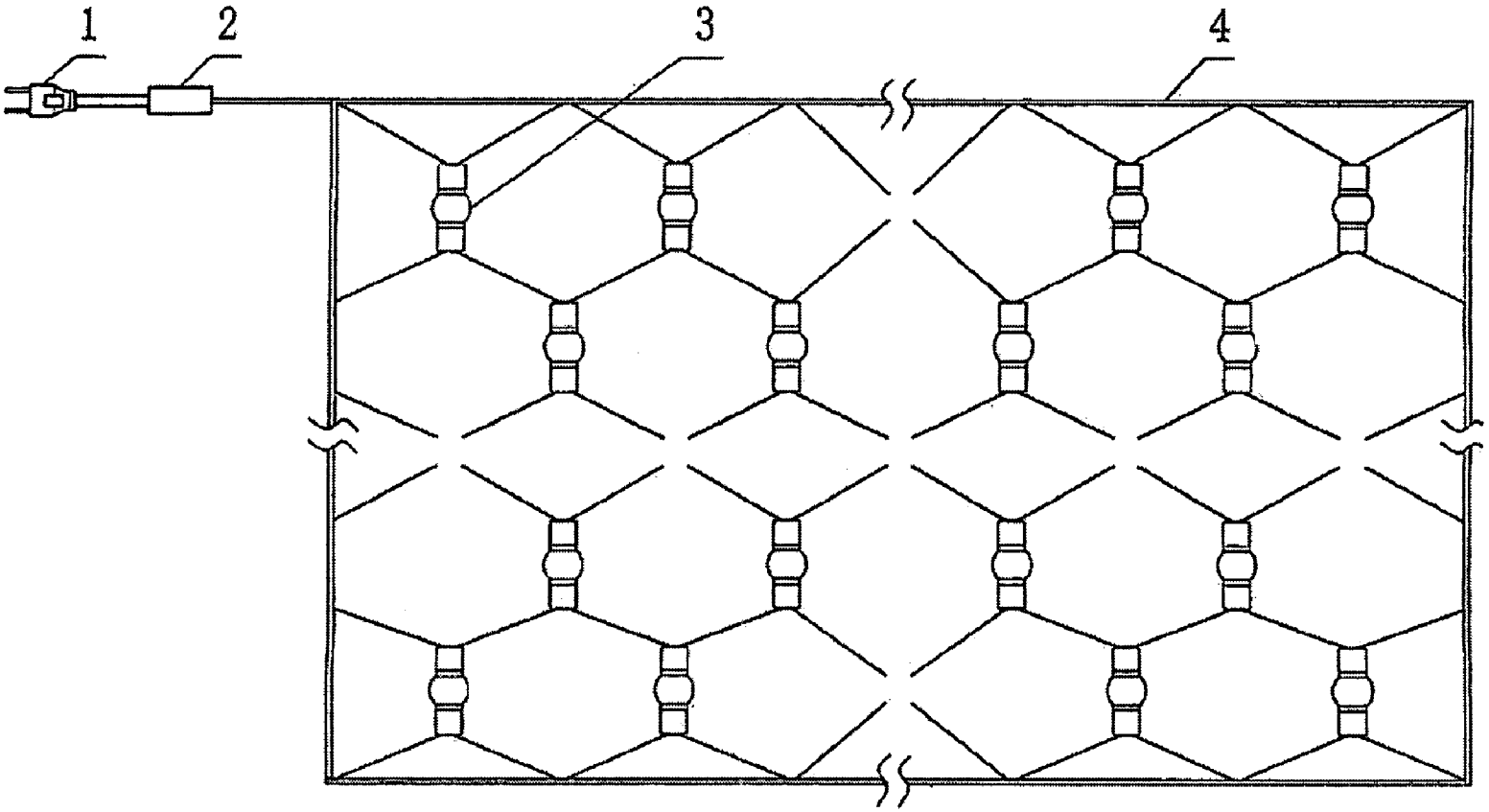
FIG. 7 illustrates a scenario where a lamp socket is columnar and a lampshade is lantern-shaped.

The lampshade 31 connected to the lamp socket 32 is a lantern-shaped, both ends of the lampshade 31 are connected to a pair of lamp sockets 32, and the lamp socket 32 is connected to wire 4 to form a reticular lamp string and a reticular seven-color decorating lamp (as shown in FIG. 7). The reticular seven-color decorating lamp is novel and has significant decorating effect.

One or two three-color self-flashing LEDs D2 may be alternatively disposed in the lampshade 31. As two three-color self-flashing LEDs D2 are used, two groups of combinations both with seven different colors can be formed, after being mixed and transmitted by the lampshade 31, more colors can be generated. If the lamp string is used for decorating buildings, novel and beautiful characteristics thereof will be highlighted, the decorated buildings will be more colorful, and a dreaming effect will be more remarkable.

The PCB in the lampshade 31 or on the lamp socket 32 is a double-side PCB, the Zener diode Dw and the current-limiting resistor R3 disposed thereon are piece components. This arrangement simplifies the manufacturing process, reduces a size of the light-emitting module 3, which decreases processing cost, and improves reliability, production rate and aesthetic appearance of products.

The seven-color light-emitting modules of the invention may be connected together to form a seven-color decorating lamp string by passing the wire 4 through the bottom of the lamp socket 32 or side portions thereof (as shown in FIG. 6). A plurality of the seven-color decorating lamp strings can be connected altogether in different manners, so as to form a lamp string with hundreds to thousands of seven-color light-emitting modules, which are more splendid and beautiful.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

What is claimed is:

1. A seven-color light-emitting module, comprising a lampshade; and a lamp socket;

wherein said lampshade is made of ivory-white light-transmission plastics or synthetic resin with good color-mixing effect and transparency;

a three-color self-flashing LED, a Zener diode, a current-limiting resistor and a printed circuit board (PCB) sealed in said lampshade are disposed on said lamp socket;

said three-color self-flashing LED is connected with said PCB, and both ends of said three-color self-flashing LED are parallel connected to said Zener diode;

one or both ends of said Zener diode are serially connected to said current-limiting resistor; and said lampshade is filled with transparent epoxy resin or silicon glue.

2. The seven-color light-emitting module of claim 1, wherein said PCB is a double-side PCB; and said Zener diode and said current-limiting resistor disposed thereon are piece components.

3. The seven-color light-emitting module of claim 1, wherein one or two three-color self-flashing LEDs are disposed in said lampshade.

4. The seven-color light-emitting module of claim 1, wherein a transparent sealing layer for sealing said three-color self-flashing LED, said PCB and said piece components on said PCB is disposed in said lampshade.

5. The seven-color light-emitting module of claim 1, wherein a thickness of said lampshade is 2-12 mm.

6. The seven-color light-emitting module of claim 1, wherein a positioning hole is axially disposed on a side wall at the bottom of said lampshade.

7. The seven-color light-emitting module of claim 1, wherein said lampshade is a sphere, a column, a rectangle, a rhombus, a lantern, or a shape of an animal.

8. The seven-color light-emitting module of claim 1, wherein said lampshade and said lamp socket is integrally formed into a sphere, a column, a rectangle, a rhombus, a lantern, or a shape of an animal.

9. A seven-color decorating lamp string, comprising a plug; and a power supply and a plurality of seven-color light-emitting modules connected via wires;

wherein said power supply comprises a house filled epoxy resin or silicon glue and a rectifying and filter circuit connected to a printed circuit board (PCB);

said seven-color light-emitting module comprises a lampshade, a lamp socket, and a three-color self-flashing LED, a Zener diode, a current-limiting resistor and said PCB disposed on said lamp socket and sealed in said lampshade;

said three-color self-flashing LED is connected with said PCB, and both ends of said three-color self-flashing LED are parallel connected to said Zener diode;

one or both ends of said Zener diode are serially connected to said current-limiting resistor; and said lampshade is filled with transparent epoxy resin or silicon glue.

10. The seven-color decorating lamp string of claim 9, wherein a plurality of said seven-color decorating lamp strings can be connected altogether in structure to form a lamp string with hundreds to thousands of seven-color light-emitting modules.

* * * * *